US006922857B2

(12) United States Patent
Palma

(10) Patent No.: US 6,922,857 B2
(45) Date of Patent: Aug. 2, 2005

(54) SHOWER BODY SUPPORT

(76) Inventor: Stanley J. Palma, 6469 Harrison Ridge Blvd., Indianapolis, IN (US) 46236

( * ) Notice: Subject to any disclaimer, the term of this patent is extended or adjusted under 35 U.S.C. 154(b) by 0 days.

(21) Appl. No.: 10/651,344

(22) Filed: Aug. 28, 2003

(65) Prior Publication Data

US 2005/0044621 A1 Mar. 3, 2005

(51) Int. Cl.[7] ..... A47K 3/12
(52) U.S. Cl. ..... 4/611; 4/573.1
(58) Field of Search ..... 4/254, 571.1, 573.1, 4/604, 611; 5/621, 630; 297/411.1, 411.21, 411.32, 464

(56) References Cited

U.S. PATENT DOCUMENTS

| | | | | |
|---|---|---|---|---|
| 1,297,980 A | | 3/1919 | Weinberger | 4/559 |
| 3,638,647 A | | 2/1972 | Creelman | 4/560.1 X |
| 3,990,120 A | * | 11/1976 | Rankin | 4/573.1 |
| 4,498,204 A | | 2/1985 | Warner | 4/611 X |
| 4,998,305 A | | 3/1991 | Davis | 4/604 |
| 5,263,207 A | | 11/1993 | Gilbert | 4/562.1 |
| 5,329,651 A | * | 7/1994 | Mardero et al. | 4/611 X |
| 5,337,525 A | * | 8/1994 | Zaccai et al. | 4/611 X |
| 5,365,618 A | | 11/1994 | Gilbert | 4/560.1 X |
| 5,465,437 A | | 11/1995 | Herman | 4/611 |
| 6,381,772 B1 | | 5/2002 | Dawson | 4/571.1 X |

* cited by examiner

*Primary Examiner*—Robert M. Fetsuga
(74) *Attorney, Agent, or Firm*—Welsh & Katz, Ltd.

(57) ABSTRACT

A system and method for providing support in the shower, such as a toroidal support which can open and can be secured around a bather's chest. In some embodiments, the support can be coupled to a vertical spine which is coupled to the wall.

40 Claims, 8 Drawing Sheets

SHOWER BODY SUPPORT

This invention pertains to a system and method for providing support in the shower.

BRIEF DESCRIPTION OF THE DRAWINGS

The components in the figures are not necessarily to scale.

DETAILED DESCRIPTION OF SOME EMBODIMENTS

Figure 1:
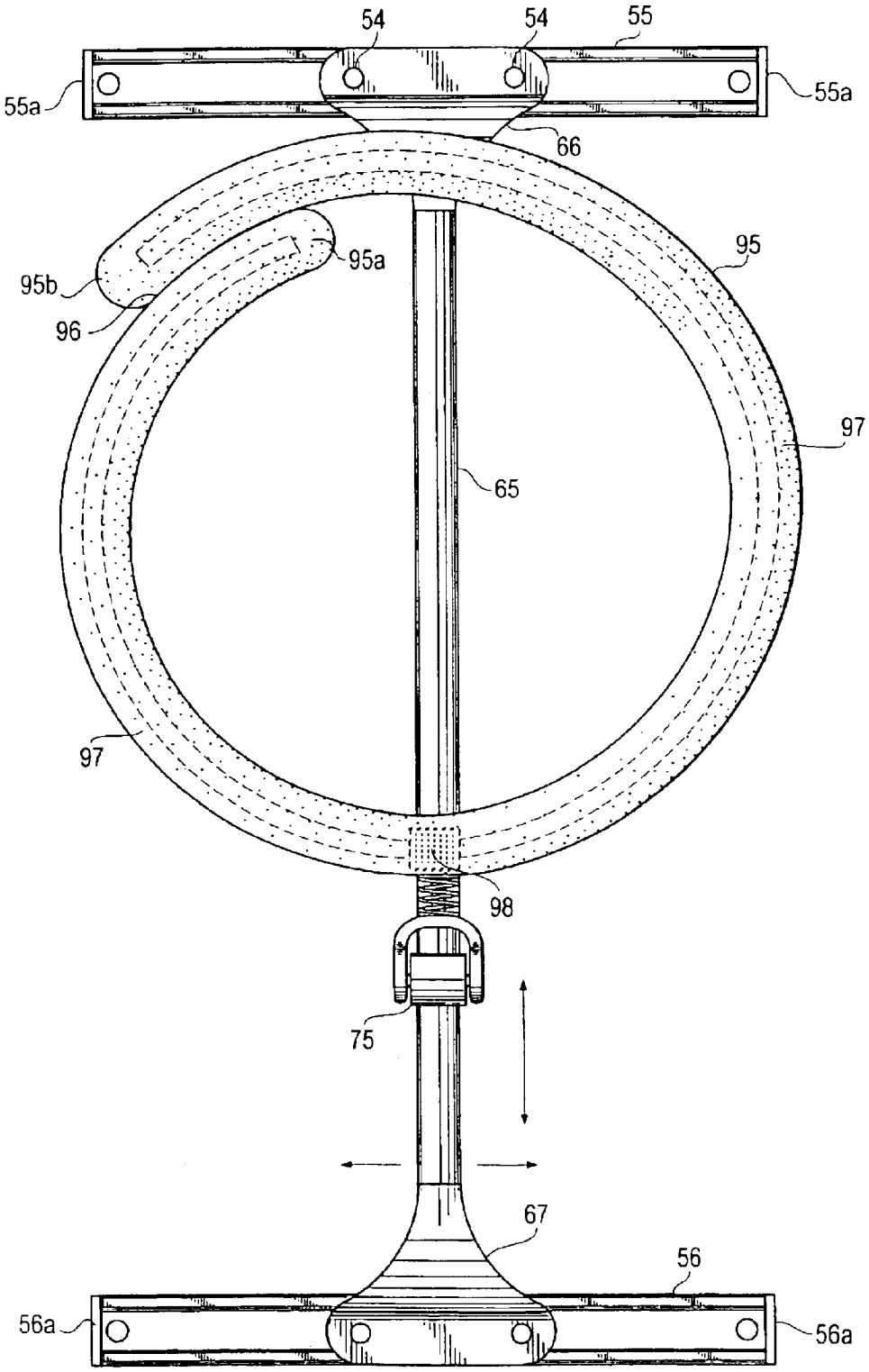
FIG. 1 is a front view of one embodiment with the body support in a raised position.

While the present invention is susceptible of embodiment in various forms, there is shown in the drawings and will hereinafter be described some embodiments with the understanding that the present disclosure is to be considered an exemplification of the invention and is not intended to limit the invention to the specific embodiments illustrated.

FIG. 1 is a front view of one embodiment of the invention. In the example of FIG. 1, a generally toroidal body support

95 can be mechanically coupled to a wall, such as a wall of a shower. For example, the body support can be used by elderly persons, special education children, or others who are physically capable of standing and using their arms, but who can use the body support to reduce the likelihood of injury if they slip in the shower. A "shower" can be any space in which one showers, such as a bath tub, a shower stall, a shower room, etc.

Figure 12:
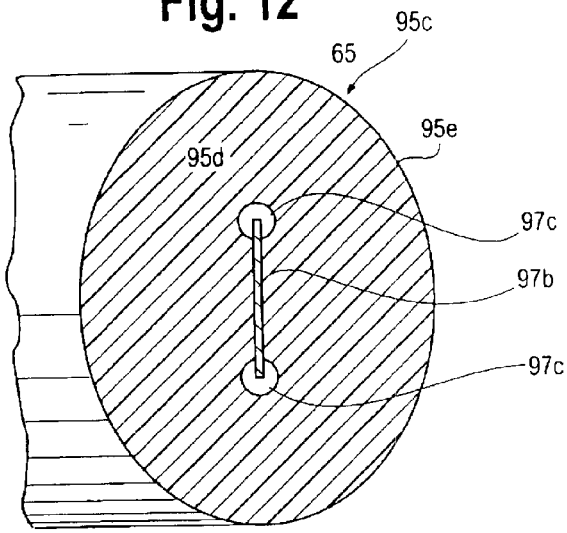
FIG. 12 is a partial cross-sectional view of another embodiment of the body support.
Figure 17:
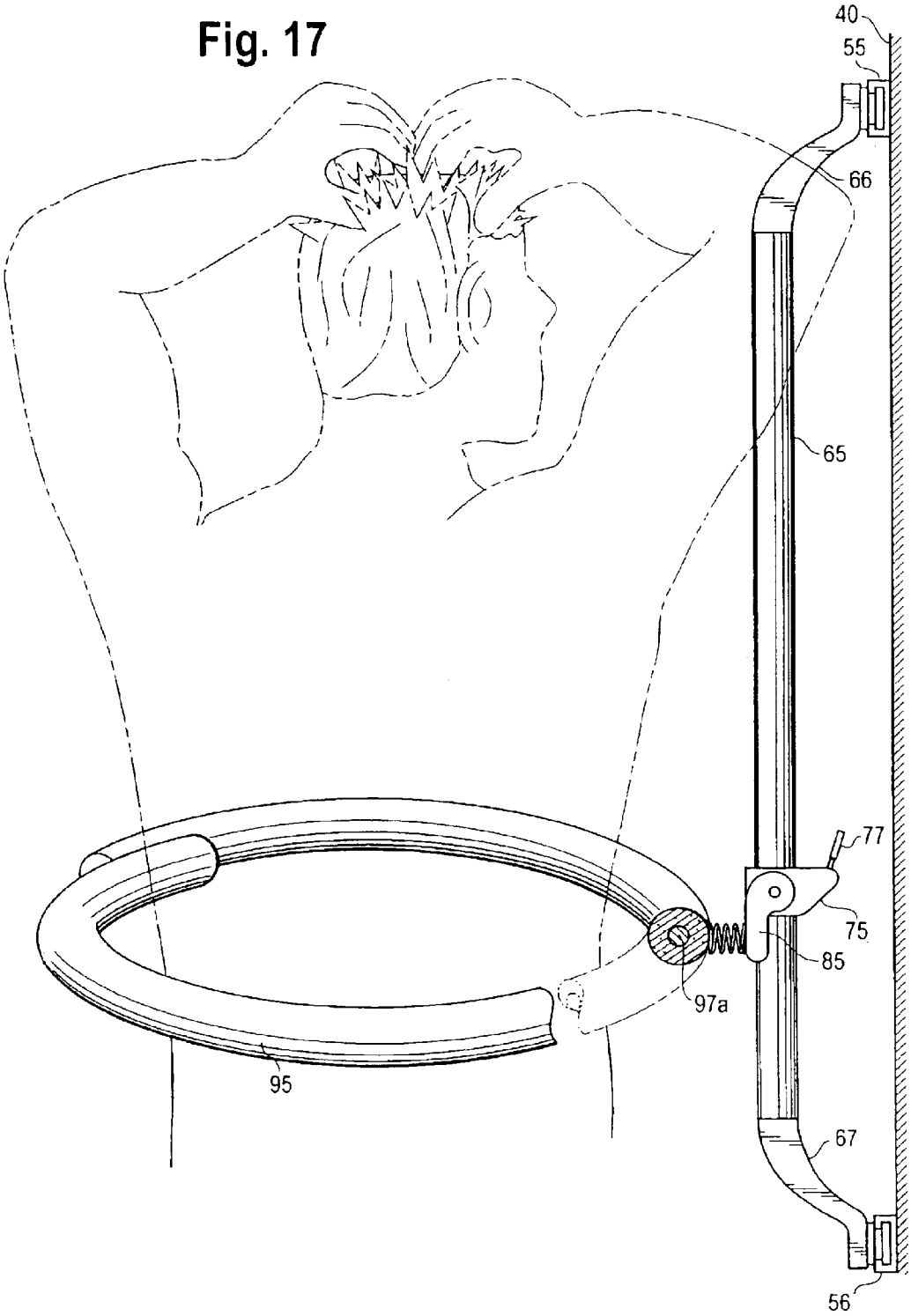
FIG. 17 is similar to FIG. 2, with the body support surrounding a person shown in phantom.

A bather should be able generally to wrap the body support 95 around at about chest level under the bather's arms, as shown in FIG. 17. Body support 95 can be, for example, closed cell foam around reinforcement. For example, the reinforcement can be a metal reinforcement such as metal tube 97 as in FIG. 1, steel cable 97*a* as in FIG. 2, or flexible steel ribbon 97*b* as in FIG. 12, or it can be other materials known in the art. The foam can comprise a waterproof coating. In the example of FIG. 12, body support 95*c* comprises steel ribbon 97*b* surrounded by closed cell foam 95*d* with a waterproof coating or finish 95*e*. Also in the example of FIG. 12, plastic guards 97*c* protect against the edges of steel ribbon 97*b* cutting through the foam 95*d*. These are only examples, and other materials can be used as is well known in the art.

In the example of FIG. 1, body support 95 includes regions 95*a* and 95*b* which can be separated from each other to allow a bather to enter or to leave. In the example of FIG. 1, regions 95*a* and 95*b* can be secured to each other to enhance the support provided by body support 95. In the example of FIG. 1, regions 95*a* and 95*b* are secured to each other with VELCRO® (or a nylon fabric that can be fastened to itself) fastening 96, but other fasteners (or means for fastening) can be used, such as hooks, snaps, zippers, and so forth, as is well known in the art.

There can be various means for allowing separation of regions 95*a* and 95*b*. For example, in the example of FIG. 1, spring connection 98 couples two parts of metal tube reinforcement 97 to facilitate movement of regions 95*a* and 95*b* relative to each other. In other examples, there can be another type of connection, or the reinforcement can be sufficiently flexible that there is no need for it to have two parts which are coupled.

The body support, such as body support 95 of FIG. 1, can be coupled to a wall via different coupling elements (and different combinations of those elements) between the body support and the wall (various examples of means for coupling the body support to the wall being illustrated in FIGS. 1–11 and 13–17), and in different ways which permit different movements relative to the wall. For example, it could be fixed to a single location on a wall or it could be allowed to move horizontally along a wall. In preferred embodiments, the body support is coupled to a vertical spine such as spine 65 of FIG. 1, and the height of that coupling can be adjusted such as to accommodate persons of different heights.

A system contemplated by the invention can be designed into new construction showers or can be built into already existing showers. A method contemplated by the invention can be an implementation or a use of the system. In some embodiments, a vertical spine can be secured to a wall adjacent columns behind the wall. In other embodiments, upper and lower horizontal mounting bars can be secured to a wall such as spanning the distance between two columns behind the wall, and a vertical spine can be coupled to the mounting bars at a location which is desirable relative to a shower head for example. In some embodiments, there can be covers over attachments to the wall. For example, there can be plastic covers which can, for example, snap over the attachments.

Various examples of means for adjusting the lateral position of a vertical spine are described in the next few paragraphs. For example, in the embodiment of FIG. 1, spine 65 includes upper and lower spine caps 66 and 67, respectively. Spine caps 66 and 67 are movingly coupled to upper and lower mounting tracks 55 and 56, respectively. In the example of FIG. 1, the height of body support 95 can be adjusted along vertical spine 65, and spine 65 can move laterally along mounting tracks 55 and 56. End blocks, such as caps 55*a* and 56*a*, pegs, or other similar mechanisms well known in the art, can prevent moving spine 65 beyond the ends of mounting tracks 55 and 56.

Figure 8:
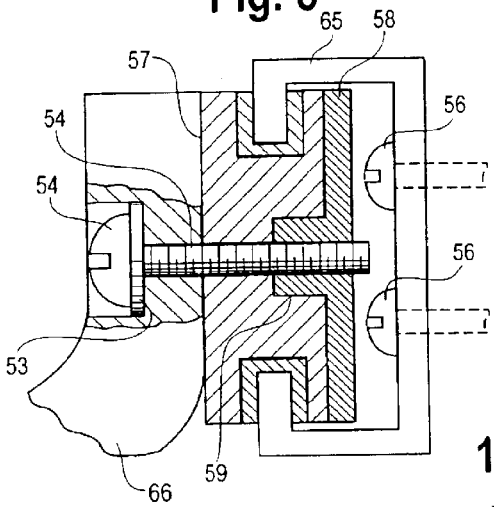
FIG. 8 is a partial side view of the upper spine cap and mounting track of one embodiment, with some of the coupling elements in cross-section.

FIG. 8 shows a partial side view of upper spine cap 66 with upper mounting track 55 and certain coupling elements in cross-section. In the example of FIG. 8, mounting track 55 can be secured to a wall by screws 56. Mounting brackets (not shown) can also be used. In other embodiments, other fasteners can be used as is well known in the art. Spine cap 66 is coupled to slide block 57 and backing plate 58 with integral nut 59 by screws 54 with reinforcements 53. In other embodiments, other fastening mechanisms can be used as is well known in the art. As seen in FIG. 8, slide block 57 can slide in mounting track 55.

Figure 15:
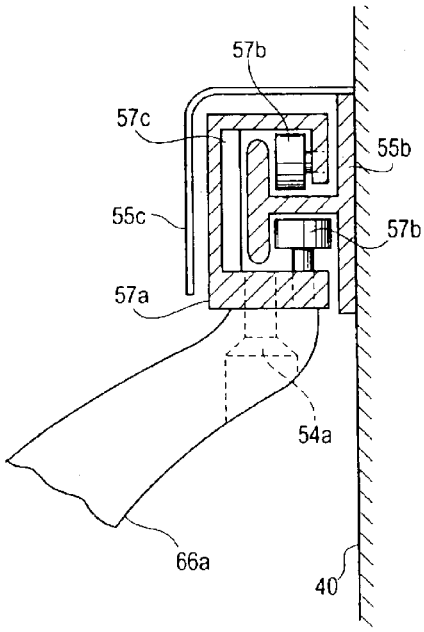
FIG. 15 is a partial side view of the upper spine cap and mounting track of another embodiment in one simulated environment, with some of the coupling elements in cross-section.
Figure 16:
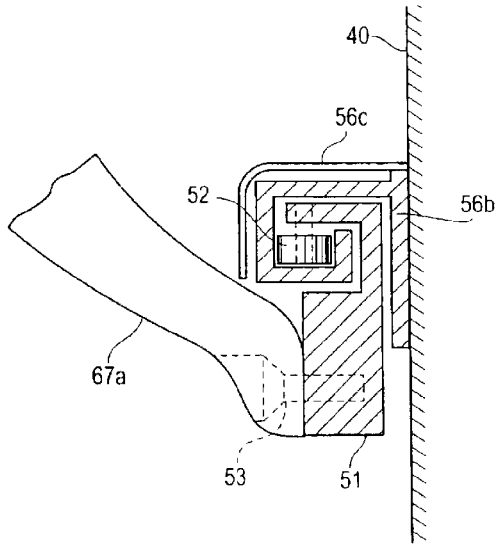
FIG. 16 is a partial side view of the lower spine cap and mounting track of another embodiment in one simulated environment, with some of the coupling elements in cross-section.

FIGS. 15 and 16 show an alternate embodiment. In the example of FIG. 15, upper mounting track 55*b* can be secured to wall 40, such as with screws or other fasteners. Upper spine cap 66*a* is coupled to slide block 57*a* with countersunk machine screw 54*a*, but other fasteners can be used as is known in the art. Slide block 57*a* includes rollers 57*b* for moving engagement with mounting track 55*b*. In the example of FIG. 15, slide block 57*a* can be formed of metal and can include anti-friction block 57*c*, which may be formed of nylon, for example. Other suitable materials can be used as is known in the art. In the example of FIG. 15, there is a cover 55*c* over these coupling elements. The cover 55*c* may be formed of plastic or other materials as is known in the art.

In the example of FIG. 16, lower mounting track 56*b* can be secured to wall 40, such as with screws or other fasteners. Lower spine cap 67*a* is coupled to slide block 51 with countersunk screws 53, but other fasteners can be used as is known in the art. Slide block 51 can be formed of metal or other materials as is known in the art. Slide block 51 can include rollers 52 for moving engagement with mounting track 56*b*. In the example of FIG. 16, there is a cover 56*c* over these coupling elements. The cover 56*c* may be formed of plastic or other materials as is known in the art.

Spine 65 can be formed of hard rubber, steel, fiberglass, urethane or other plastic, or other materials. Spine caps 66, 66*a*, 67 and 67*a* can be formed of hard rubber with steel inserts, urethane with steel inserts, cast metal, or other materials. Mounting tracks 55, 55*b*, 56 and 56*b* can be aluminum extrusions or can be formed of other materials or in other ways. End caps 55*a* and 56*a* can be formed of hard rubber, plastic, or other materials. Slide blocks 57 can be formed of TEFLON® (or synthetic flourine-containing resins), nylon, or other materials. Backing plate 58 can be formed of steel or other materials. Reinforcement 53 can be formed of steel or other materials.

A body support, such as body support 95, can be coupled to a vertical spine, such as spine 65, in different ways. Various examples of means for adjusting the height of a body support are described in the next few paragraphs. For example, in the example of FIG. 1, body support 95 is coupled to a collar 75. Collar 75 can be adjusted up and down spine 65, as illustrated in FIGS. 3 through 6 for example. In that example, part of the surface of spine 65, and particularly the part of spine 65 facing the wall in the example of FIGS. 3 through 6, is molded with or otherwise includes successive catch areas 68. A catch 76 is rotatably coupled to collar 75, such as about pivot shaft 78. A spring such as axial spring 79 biases the orientation of catch 76 relative to collar 75, to engage catch 76 in a catch area 68 and to prevent collar 75 from moving along spine 65 in at least one direction.

In the example of FIGS. 3 through 6, catch 76 includes a catch release paddle 77. Paddle 77 can be integral with the rest of catch 76, or can be formed separately and can be coupled to the rest of catch 76 such as, for example, by screwing into the rest of catch 76. Paddle 77 can be rotated about pivot shaft 78 against the bias of spring 79 to move catch 76 out of a catch area 68, and to allow collar 75 to be adjusted up or down along spine 65.

Figure 4:
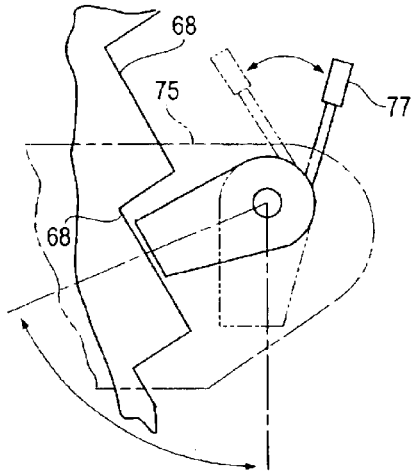
FIG. 4 is a partial side view, showing parts of the spine, the collar and the catch of the embodiment of FIG. 3, the part of the catch enclosed in the collar shown in phantom, the rotated catch and paddle also shown in phantom.
Figure 5:
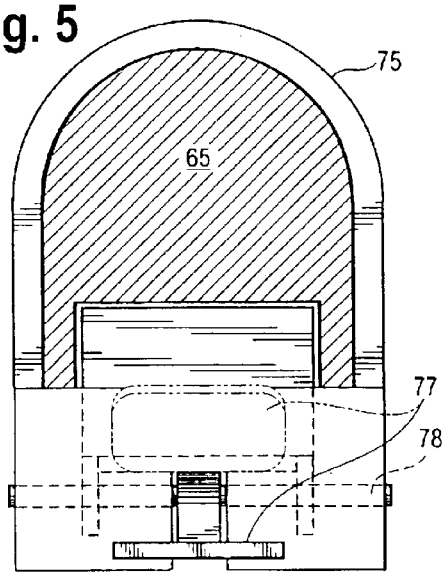
FIG. 5 is a partial top view, showing parts of the collar and catch of the embodiment of FIG. 3, with the spine in cross-section.
Figure 6:
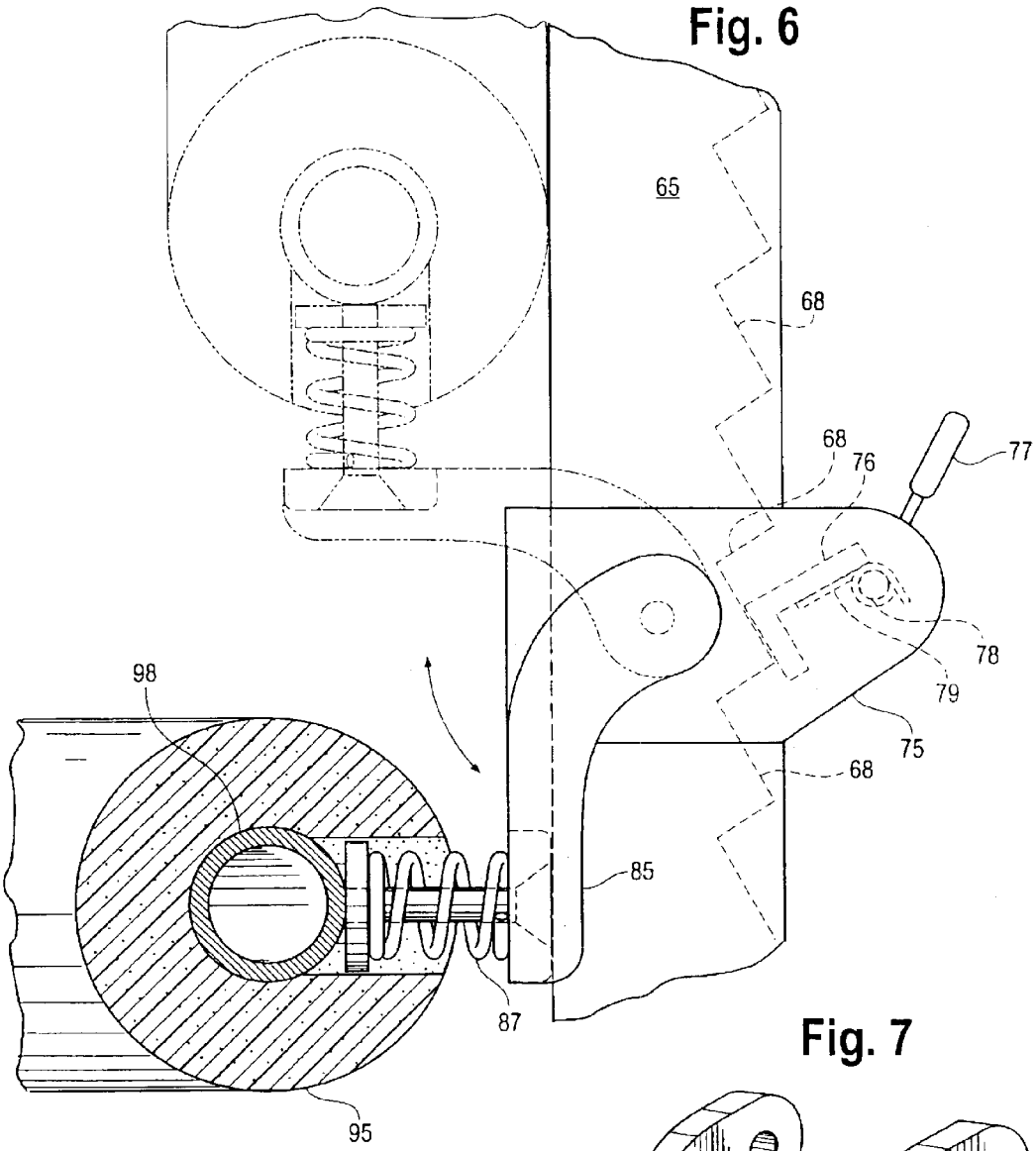
FIG. 6 is a partial side view on one embodiment, showing the body support in cross-section, with the yoke shown for a horizontal position and for a raised position in phantom.

This arrangement can be a rachet mechanism in some embodiments. As best seen in the example of FIGS. 4 and 6, collar 75 can be raised higher along spine 65 simply by pushing it up. The upward force will push catch 76 against a surface of spine 65 which is at an angle with catch area 68, rotating catch 76 against the bias of spring 79 and allowing collar 75 to rise. However, the weight of body support 95 and the various coupling elements (or even pushing collar 75 down) will push catch 76 into catch area 68, will not rotate catch 76, and will not allow collar 75 to fall—unless paddle 77 is rotated about pivot shaft 78 releasing catch 76.

Figure 2:
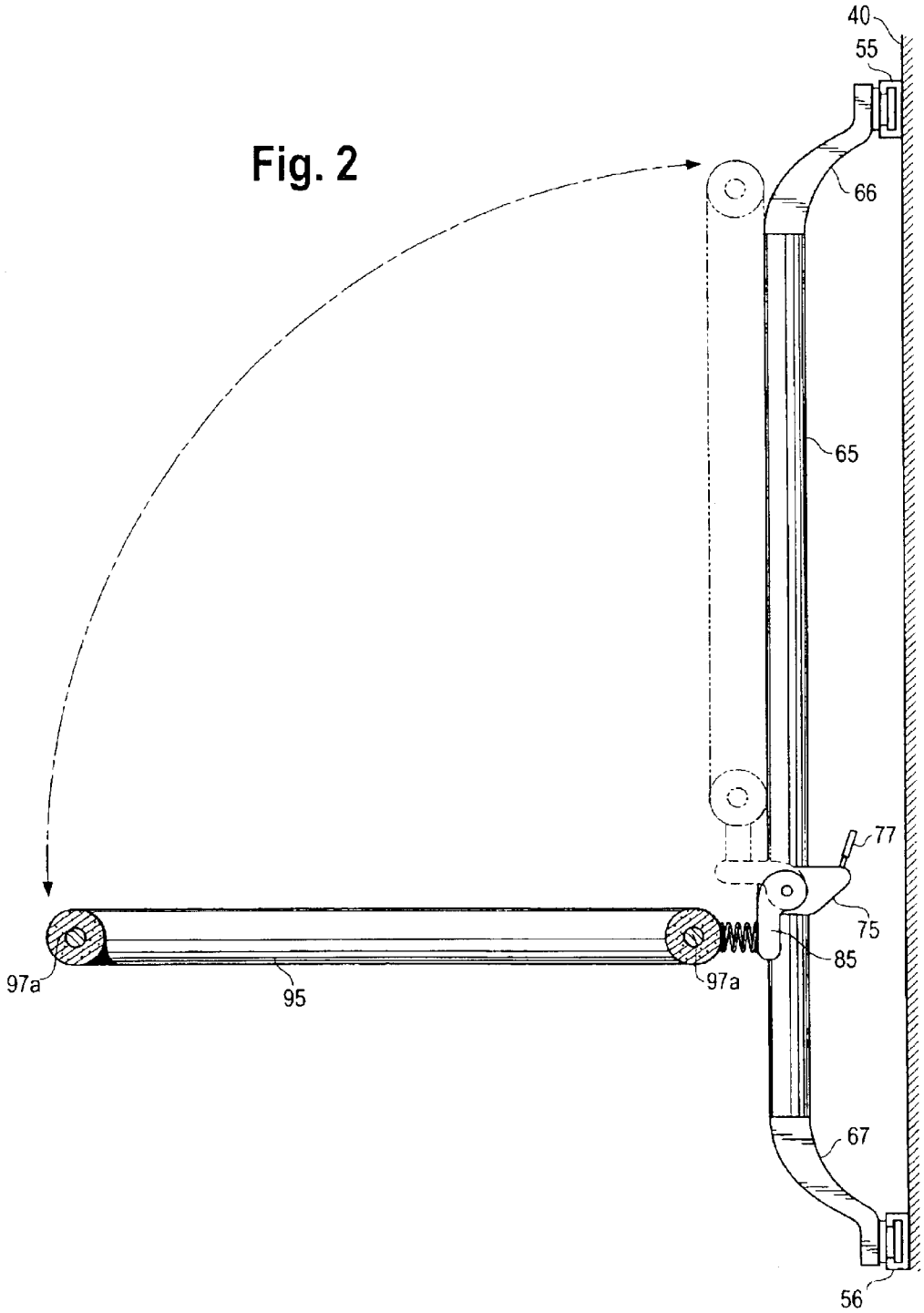
FIG. 2 is a side view in one simulated environment, with the body support shown in a horizontal position, and in a raised position in phantom.
Figure 3:
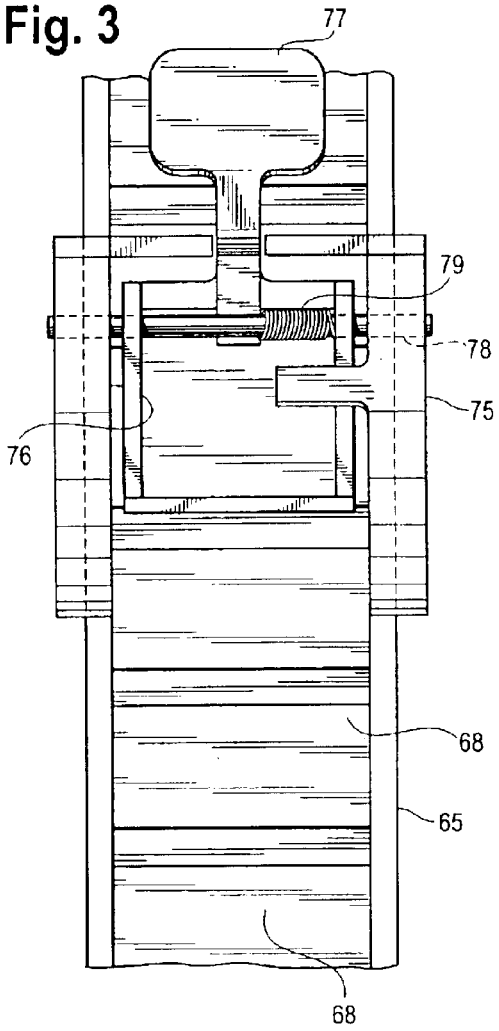
FIG. 3 is a partial rear view, showing parts of the spine, the collar and the catch of one embodiment.
Figure 7:
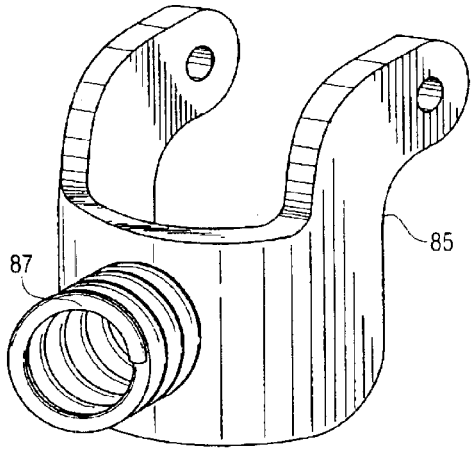
FIG. 7 is a perspective view of the yoke and spring coil of the embodiment of FIG. 6.

A body support, such as body support 95, can be coupled collar 75 in different ways. Some those ways provide for adjusting an angular orientation of a body support relatie to a spine. Various examples of means for adjusting that angular orientation are described in the next few paragraphs. For example, as shown in the example of FIGS. 2 and 6, body support 95 is coupled to a yoke 85. FIG. 7 shows a perspective view of one example of a yoke 85 and spring coil 87. As best seen in the example of FIG. 6, yoke 85 can be rotatably coupled to collar 75. For example, yoke 85 can be coupled to collar 75 with riveted pins 86 which allow rotation. Other fasteners can be used in other embodiments, as is well known in the art.

In the example of FIGS. 2 and 6, the relationships of body support 95, yoke 85 and spine 65 permit yoke 85 to rotate only about 90°. In other examples, different ranges of rotation can be permitted. In the example of FIGS. 2 and 6, yoke 85 can be rotated down until it meets spine 65. At that point, body support 95 is in a generally horizontal position suitable for use during bathing. Body support 95 can be rotated up to a generally vertical position, which may be more desirable when body support 95 is not being used. Body support 95 is shown in the raised, generally vertical position, in the example of FIG. 1 (and in phantom in FIG. 2).

Yoke 85, collar 75 and catch 76 can be formed of high strength plastic, cast metal such as aluminum or steel, or some other materials. In some examples, there can be an interface, such as a TEFLON® (or synthetic flourine-containing resins) interface, between the collar and the spine to facilitate sliding adjustment of the collar along the spine.

In other embodiments, rotation of a body support relative to a collar can release a catch permitting the collar to move along the spine. For example, in the embodiment of FIGS. 9 through 11, part of the surface of vertical spine 101 facing away from a wall is molded with or otherwise includes successive catch areas 107. A collar 102 can be adjusted up and down spine 101. A catch 106 is rotatably coupled to collar 102 about pivot point 103. A body support (not shown) can be coupled to a connector 105 which is rotatably coupled to collar 102 about pivot point 104.

Figure 10:
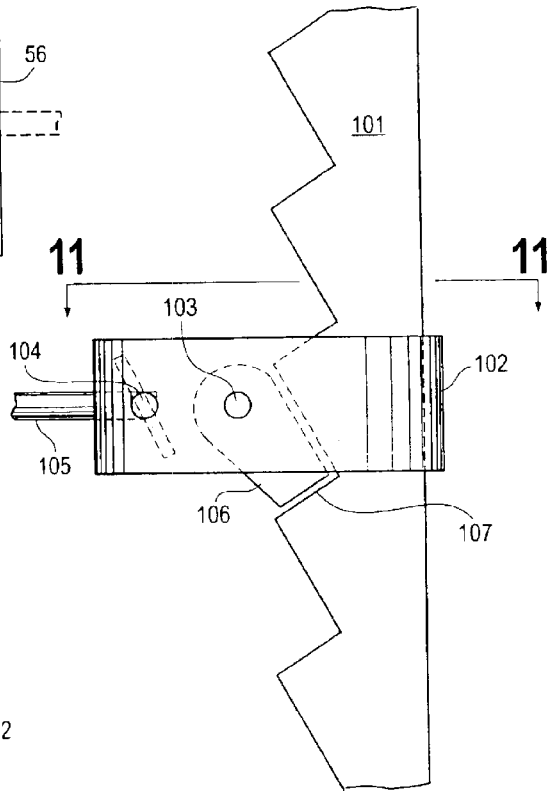
FIG. 10 is a partial side view view of the embodiment of FIG. 9.
Figure 9:
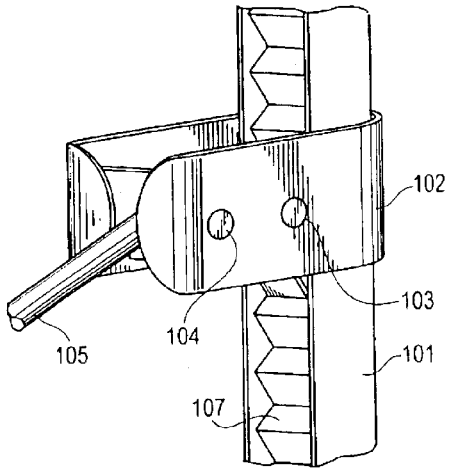
FIG. 9 is a partial perspective view of another embodiment.
Figure 11:
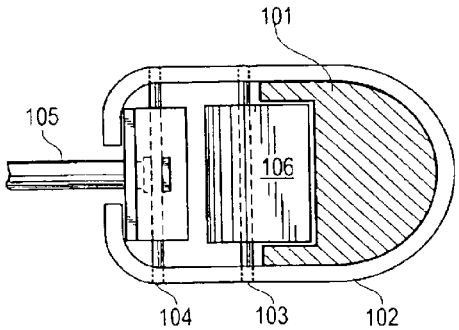
FIG. 11 is a partial cross-sectional top view taken along line 11—11 of FIG. 10.

In the example of FIGS. 9 through 11, catch 106 can be released when connector 105 is in one orientation with respect to collar 102. For example, catch 106 can be released when connector 105 is rotated down and a coupled body support is hanging in a generally vertical position. In that position, collar 102 can be adjusted along spine 101. When connector 105 is rotated up and a coupled body support is in a generally horizontal position suitable for use during bathing, catch 106 is pushed into a catch area 107 along spine 101 preventing collar 102 from sliding down spine 101. In that position, collar 102 can be prevented from sliding up or down in some examples. In other examples, the elements can be arranged as a ratchet mechanism, permitting collar 102 to be raised but not lowered until the connector is rotated relative to the collar.

Figure 13:
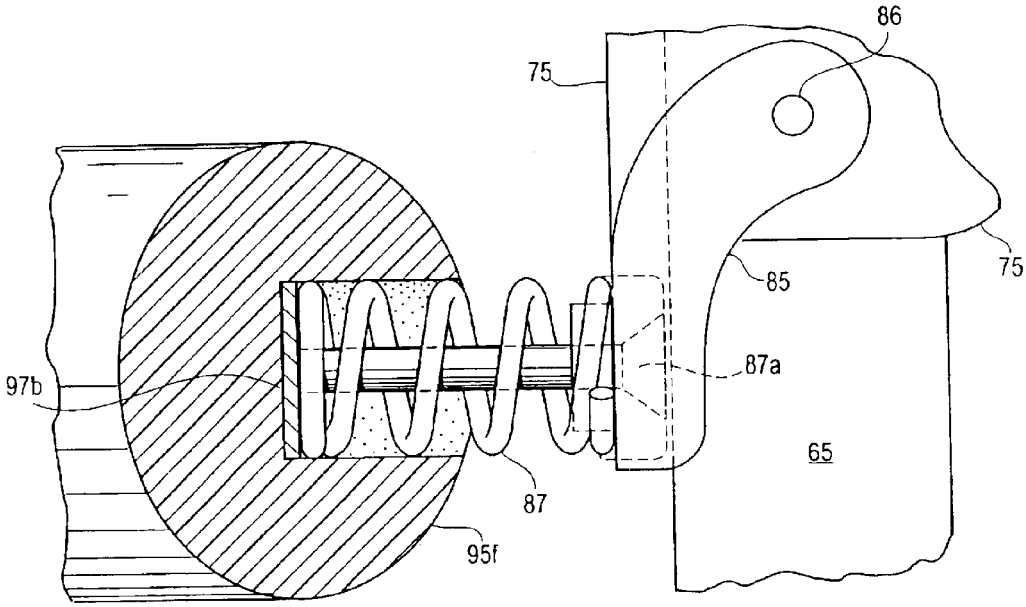
FIG. 13 is a partial side view on another embodiment, showing the body support in cross-section.

Various examples of means for flexing different coupling elements are described in the next few paragraphs. For example, in the embodiment of FIG. 6, body support 95 is coupled to collar 75 by a connector comprising yoke 85 and spring coil 87. Spring coil 87 permits some flexibility and, in some examples, can add to any flexibility inherent in spine 65. In some examples, spring coil 87 can be welded to spring connection 98 as shown in FIG. 6. In the embodiment of FIG. 13, body support 95*f* is coupled to collar 75 by a connector comprising yoke 85 and spring coil 87. Spring coil 87 is shown fastened to yoke 85 by a countersunk flathead machine screw, and is welded to steel ribbon 97*b*. In some examples, spring coil 87 can be surrounded by a foam cover.

Figure 14:
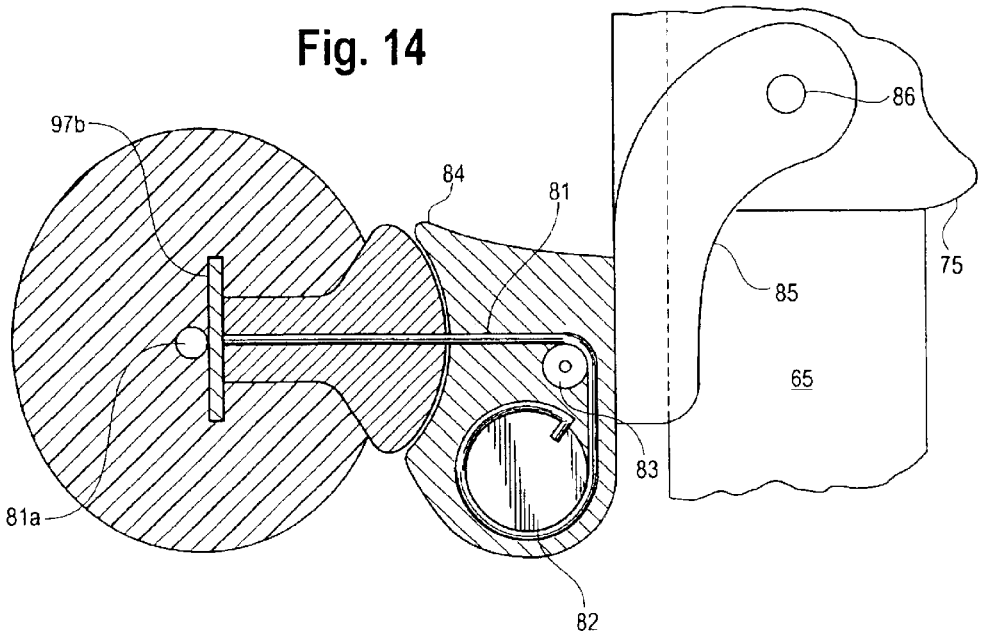
FIG. 14 is a partial side view on another embodiment, showing the body support and the cable and housing in cross-section.

In the embodiment of FIG. 14, body support 95*g* is coupled to collar 75 by a connector comprising yoke 85 and a cable system. In the example of FIG. 14, the cable system comprises a cable 81 passing through a two-part housing 84. Housing 84 can be integral with yoke 85, or can be secured to yoke 85 by screws or other fasteners as is known in the art. A cable attachment 81*a* prevents one end of cable 81 from pulling through steel ribbon 97*b* which reinforces body support 95*g*. In the example of FIG. 14, cable 81 passes over a pulley 83, and the second end of cable 81 is attached to inertial reel 82. Inertial reels, which are known in the art, are spring-loaded and work like seat belt retractors, for example. The cable and reel of the embodiment of FIG. 14 allow the bather to extend the body support for a limited distance away from the spine, and constitute one example of a means for moving a body support a limited distance from a wall.

In other embodiments, other connectors can be used to couple a body support to a collar. For example, connector 105 shown in FIGS. 9 through 11 can be a steel cable in some examples. In some examples, the joint between connector 105 and collar 102 can be a heim-type joint to increase flexibility.

As mentioned above, a method contemplated by the invention can be an implementation or a use of any of the different systems or features of those systems, such as those systems and features described above. For example, supporting a person in a shower may include adjusting a lateral position of a vertical spine 65, such as for example by moving a slide block 57 in a mounting track 55 that is coupled to a wall of the shower (see e.g., FIGS. 1, 2 and 8). For example, it may include adjusting a height of a body support 95 along vertical spine 65 (see e.g., FIGS. 1 and 2), and possibly engaging a catch 76 in a catch area 68 of the spine 65 (see e.g., FIGS. 3–6). For example, it may include adjusting an angular orientation of body support 95 relative to vertical spine 65, such as for example by rotating a yoke 85 or other connector 105 (see e.g. FIGS. 2, 6 and 9). For example, it may include separating regions 95*a* and 95*b* of body support 95 to allow entry of the person, positioning body support 95 around the person's chest, and fastening regions 95*a* and 95*b* to each other (see e.g., FIGS. 1 and 17).

From the foregoing it will be observed that numerous modifications and variations can be effectuated without departing from the true spirit and scope of the novel concepts of the present invention. It is to be understood that no limitation with respect to the specific embodiments illustrated is intended or should be inferred.

What is claimed is:

1. A method to support a person in a shower, the method comprising:

adjusting a height of a body support along a vertical spine coupled to a wall of the shower;

wherein the body support is coupled to the spine;

the height adjusting step comprising engaging a catch in a catch area of the spine to prevent movement of the body support in at least one direction along the spine;

separating first and second regions of the body support to allow entry of the person to an area generally bordered by the body support;

positioning the body support generally around the person's chest and under the person's arms.

2. The method of claim 1, further comprising fastening the first and second regions to each other.

3. The method of claim 1, wherein the spine is coupled to a mounting bar and the mounting bar is coupled to the wall.

4. The method of claim 1, further comprising adjusting a lateral position of the spine along the wall.

5. The method of claim 1, further comprising:

adjusting an angular orientation of the body support relative to the spine;

wherein the body support is coupled to a connector;

wherein the angular orientation adjusting step comprises rotating the connector;

wherein the height adjusting step further comprises disengaging the catch from the catch area by rotating the connector to permit movement of the body support in the at least one direction.

6. The method of claim 1, further comprising adjusting an angular orientation of the body support relative to the spine.

7. A method to support a person in a shower, the method comprising:

adjusting a height of a body support along a vertical spine coupled to a wall of the shower;

wherein the body support is coupled to the spine;

adjusting a lateral position of the spine along the wall;

the lateral position adjusting step comprising moving a slide block in a mounting track;

wherein the spine is coupled to the slide block and the mounting track is coupled to the wall;

separating first and second regions of the body support to allow entry of the person to an area generally bordered by the body support;

positioning the body support generally around the person's chest and under the person's arms.

8. A support system to support a person in a shower, the system comprising:

a body support;

a coupling element;

the coupling element capable of coupling the body support to a wall of the shower;

the coupling element comprising a vertical spine;

a height of the body support adjustable along the spine;

the coupling element further comprising a mounting track;

the mounting track mountable to the wall;

the spine movingly coupled to the mounting track;

the body support suitable to fit generally around the person's chest under the person's arms;

the body support comprising first and second regions;

the body support allowing separation of the first and second regions;

wherein, when the first and second regions are separated, the person can enter an area generally bordered by the body support.

9. The support system of claim 8, the mounting track comprising an end block;

the end block blocking movement of the spine beyond an end of the mounting track.

10. The support system of claim 8, the coupling element further comprising a slide block;

the slide block movable in the mounting track;

the spine coupled to the slide block.

11. The support system of claim 10, the slide block comprising a roller.

12. The support system of claim 8, the coupling element further comprising a rachet mechanism;

wherein the height of the body support can be raised but will not be lowered unless the rachet mechanism is released.

13. A support system to support a person in a shower, the system comprising:

a body support;

means for coupling the body support to a wall of the shower;

the coupling means comprising a vertical spine;

the coupling means further comprising a mounting track;

means for adjusting a lateral position of the spine along the mounting track;

means for adjusting a height of the body support along the spine;

the body support suitable to fit generally around the person's chest under the person's arms;

the body support comprising first and second regions;

means for allowing separation of the first and second regions;

wherein, when the first and second regions are separated, the person can enter an area generally bordered by the body support.

14. The support system of claim 13, wherein the body support is generally toroidal.

15. The support system of claim 13, the body support further comprising:

metal reinforcement;

foam;

the foam generally surrounding the metal reinforcement;

the foam comprising a waterproof coating.

16. The support system of claim 13, further comprising means for fastening the first and second regions to each other.

17. The support system of claim 13, the height adjusting means comprising a rachet mechanism.

18. The support system of claim 13, further comprising means for adjusting an angular orientation of the body support relative to the spine.

19. The support system of claim 13, further comprising means for flexing the coupling means.

20. The support system of claim 19, the flexing means comprising means for moving the body support a limited distance from the wall.

21. A support system to support a person in a shower, the system comprising:

a body support;

a coupling element;

the coupling element capable of coupling the body support to a wall of the shower;

the coupling element comprising a vertical spine;

the spine mountable to the wall;

a height of the body support adjustable along the spine;

the coupling element further comprising a collar;

the body support coupled to the collar;

the coupling element further comprising a catch;

the spine comprising a catch area;

a location of the collar adjustable along the spine;

the collar prevented from moving in at least one direction along the spine, when the catch engages the catch areas;

the body support suitable to fit generally around the person's chest under the person's arms;

the body support comprising first and second regions;

the body support allowing separation of the first and second regions;

wherein, when the first and second regions are separated, the person can enter an area generally bordered by the body support.

22. The support system of claim 21, wherein the body support is generally toroidal.

23. The support system of claim 21, the body support further comprising metal reinforcement.

24. The support system of claim 23, the body support further comprising foam;

the foam generally surrounding the metal reinforcement.

25. The support system of claim 24, the foam comprising a waterproof coating.

26. The support system of claim 24, the body support further comprising guards;

the guards protecting against edges of the reinforcement cutting through the foam.

27. The support system of claim 23, the metal reinforcement selected from a group consisting of metal tube, steel ribbon, and steel cable.

28. The support system of claim 21, the body support further comprising a fastening mechanism;

the fastening mechanism capable, of securing the first and second regions to each other.

29. The support system of claim 21, the body support further comprising:

first and second parts;

a spring connection;

the spring connection coupling the first and second parts.

30. The support system of claim 29, the coupling element coupled to the spring connection.

31. The support system of claim 21, the coupling element further comprising a mounting bar;

the mounting bar mountable to the wall;

the spine coupled to the mounting bar.

32. The support system of claim 21, further comprising:

a catch release;

the catch movably coupled to the collar;

wherein movement of the catch release relative to the collar can disengage the catch from the catch area.

33. The support system of claim 21, further comprising:

a bias spring;

the bias spring capable of biasing the catch against disengagement from the catch area.

34. The support system of claim 21, the coupling element further comprising a connector;

the body support coupled to the connector;

the connector rotatably coupled to the collar;

wherein rotation of the connector can change an orientation of the body support relative to the collar.

35. The support system of claim 34, the connector rotatable through a range of about 90°;

wherein the connector cannot be rotated lower after the orientation of the body support is generally horizontal.

36. The support system of claim 34, the coupling element further comprising a catch;

the spine comprising a catch area;

the collar prevented from moving in at least one direction along the spine, when the catch engages the catch area;

wherein rotation of the connector can disengage the catch from the catch area.

37. The support system of claim 21, the coupling element comprising a spring;

the body support coupled to the spring.

38. The support system of claim 21, the coupling element comprising a cable system;

the cable system comprising a cable;

the body support coupled to the cable;

wherein movement of the cable allows movement of the body support a limited distance from the wall.

39. The support system of claim 38, the cable system comprising an inertial reel.

40. The support system of claim 21, further comprising:

a cover;

the cover covering at least part of the coupling element.

* * * * *

UNITED STATES PATENT AND TRADEMARK OFFICE

CERTIFICATE OF CORRECTION

PATENT NO. : 6,922,857 B2
DATED : August 2, 2005
INVENTOR(S) : Stanley J. Palma

It is certified that error appears in the above-identified patent and that said Letters Patent is hereby corrected as shown below:

Column 8,
Line 29, please delete “areas;” and insert therefor -- area; --.
Line 58, please delete the comma after “capable”.

Signed and Sealed this

Fourth Day of October , 2005

JON W. DUDAS
*Director of the United States Patent and Trademark Office*